US006802483B1

(12) United States Patent
Leasure

(10) Patent No.: US 6,802,483 B1
(45) Date of Patent: Oct. 12, 2004

(54) GUN REST AND CLAMP

(76) Inventor: Richard L. Leasure, 11355 Backus Rd., Wattsburg, PA (US) 16442

( * ) Notice: Subject to any disclaimer, the term of this patent is extended or adjusted under 35 U.S.C. 154(b) by 0 days.

(21) Appl. No.: 10/395,583

(22) Filed: Mar. 24, 2003

Related U.S. Application Data

(63) Continuation-in-part of application No. 10/334,389, filed on Dec. 31, 2002, now Pat. No. 6,679,465.

(51) Int. Cl.[7] ..... A47B 96/00
(52) U.S. Cl. ..... 248/229.15; 182/187; 248/229.12
(58) Field of Search ..... 42/94; 248/229.15, 248/229.25, 228.1, 228.6, 309.1, 292.12; 182/187, 188, 116, 135, 136

(56) References Cited

U.S. PATENT DOCUMENTS 3,022,898 A * 2/1962 Loeb ..... 211/64
5,913,668 A * 6/1999 Messer ..... 42/94
5,933,999 A * 8/1999 McClure et al. ..... 42/94
5,974,719 A * 11/1999 Simonek ..... 42/94
6,086,031 A * 7/2000 Renfro ..... 248/218.4
6,305,117 B1 * 10/2001 Hales, Sr. ..... 42/94
6,546,662 B1 * 4/2003 Chong ..... 42/94
6,574,899 B1 * 6/2003 Mostello ..... 42/94

* cited by examiner

*Primary Examiner*—Ramon O Ramirez
(74) *Attorney, Agent, or Firm*—Richard K Thomson

(57) ABSTRACT

A gun rest made of a high-strength, highly durable plastic, such as ABS, is attachable to a tree stand. First and second U-shaped members have a mechanical element to permit its attachment to a portion of the frame of the tree stand. In a first embodiment, the attachment element is a third member with a ratchet face that engages a ratchet on the rear face of the first and second U-shaped members along with an T-shaped clamping arm that is adjustably bolted to the U-shaped member. The T-shaped clamping arm can be used to clamp other elements to the frame of the tree stand, as well. In a second embodiment the attachment element is a dowel that is received in an open end of the tree stand frame. The portions of the U-shaped members that support the gun are jacketed with an elastomeric non-slip surface that is preferably made of rubber.

15 Claims, 4 Drawing Sheets

GUN REST AND CLAMP

This is a Continuation-in-part (CIP) of prior application Ser. No. 10/334,389, filed Dec. 31, 2002, now U.S. Pat. No. 6,679,465.

BACKGROUND AND SUMMARY OF THE INVENTION

The present invention is directed to the field of hunting accessories. More particularly, the present invention is directed to a gun rest for use in a tree stand, or the like. The present invention is a continuation-in-part of U.S. patent application Ser. No. 10/334,389 filed Dec. 31, 2002 entitled Bow Rest which is hereby incorporated by reference.

Hunting, both bow and rifle or shot gun, is an increasingly popular sport, requiring significant skill and stealth. Tree stands can provide a certain level of creature comforts for a hunter out in the elements awaiting the quarry's approach. However, holding a high-powered bow or shoulder weapon at the ready can produce muscle fatigue that leads to an errant shot. On the other hand, lifting the weapon from an at rest position, bringing it to a firing position, taking aim and firing will typically involve too much motion and potentially noise-producing movement to not spook the game. Accordingly, a need exists for holding a shoulder-fired weapon in a horizontal position where it may be easily brought to the ready position with a minimum of commotion.

There are two primary embodiments of the gun rest of the present invention. Each embodiment comprises two identical U-shaped members with means to attach the elements to the tree stand. A non-slip coating is applied to the support portions of the gun rest. In the first embodiment, the attachment means comprises integral dowels that are inserted into the hollow ends of the tree stand frame. In the second embodiment, an adjustable T-shaped clamp arm identical to the one used in the parent application is provided to permit the two gun rest members to be clamped to opposed frame arms The first and second U-shaped members and the T-shaped clamp arms are preferably made of a high strength, high durability plastic such as acrylonitrile-butadiene-styrene (ABS). The non-slip coating is preferably synthetic or natural rubber.

Various other features, advantages and characteristics will become apparent after a reading of the following specification.

BRIEF DESCRIPTION OF THE DRAWINGS

The preferred embodiment(s) of the present invention are set forth in the drawings, like items bearing like reference numerals and in which.

DETAILED DESCRIPTION OF THE PREFERRED EMBODIMENTS

Figure 1:
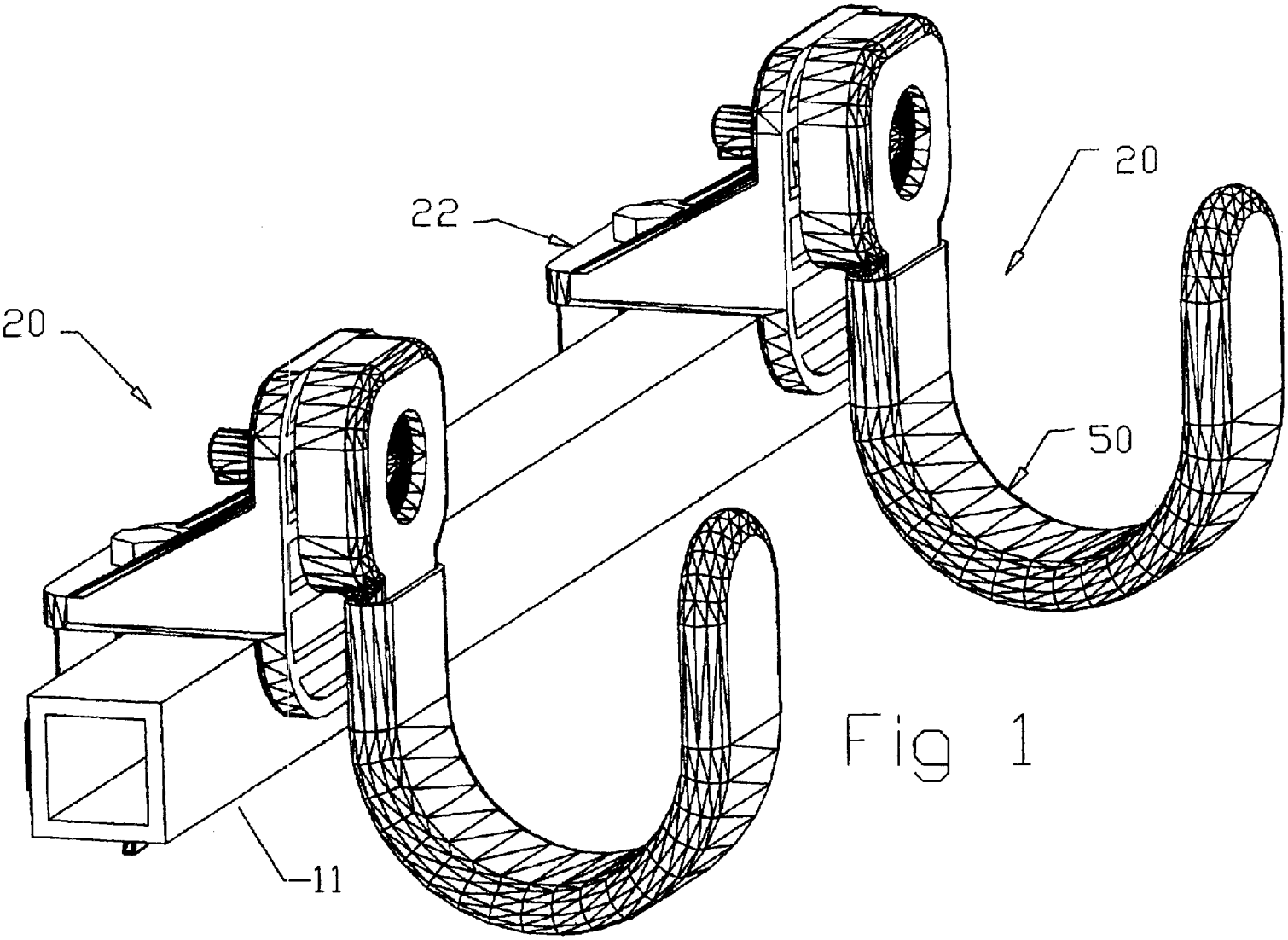
FIG. 1 is a right front perspective view of a first embodiment of the gun rest of the present invention.
Figure 2:
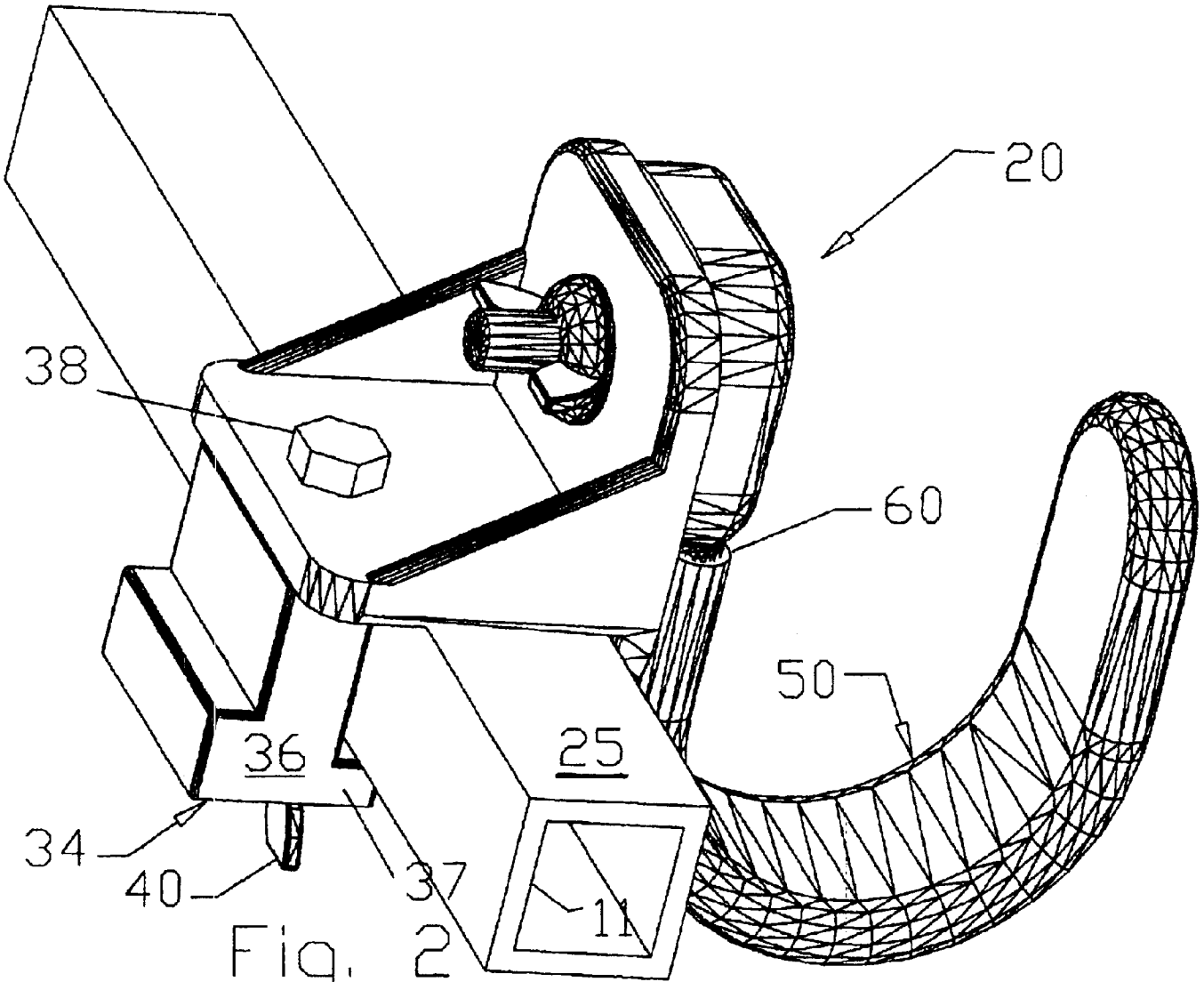
FIG. 2 is a right rear perspective view of the first embodiment.
Figure 3:
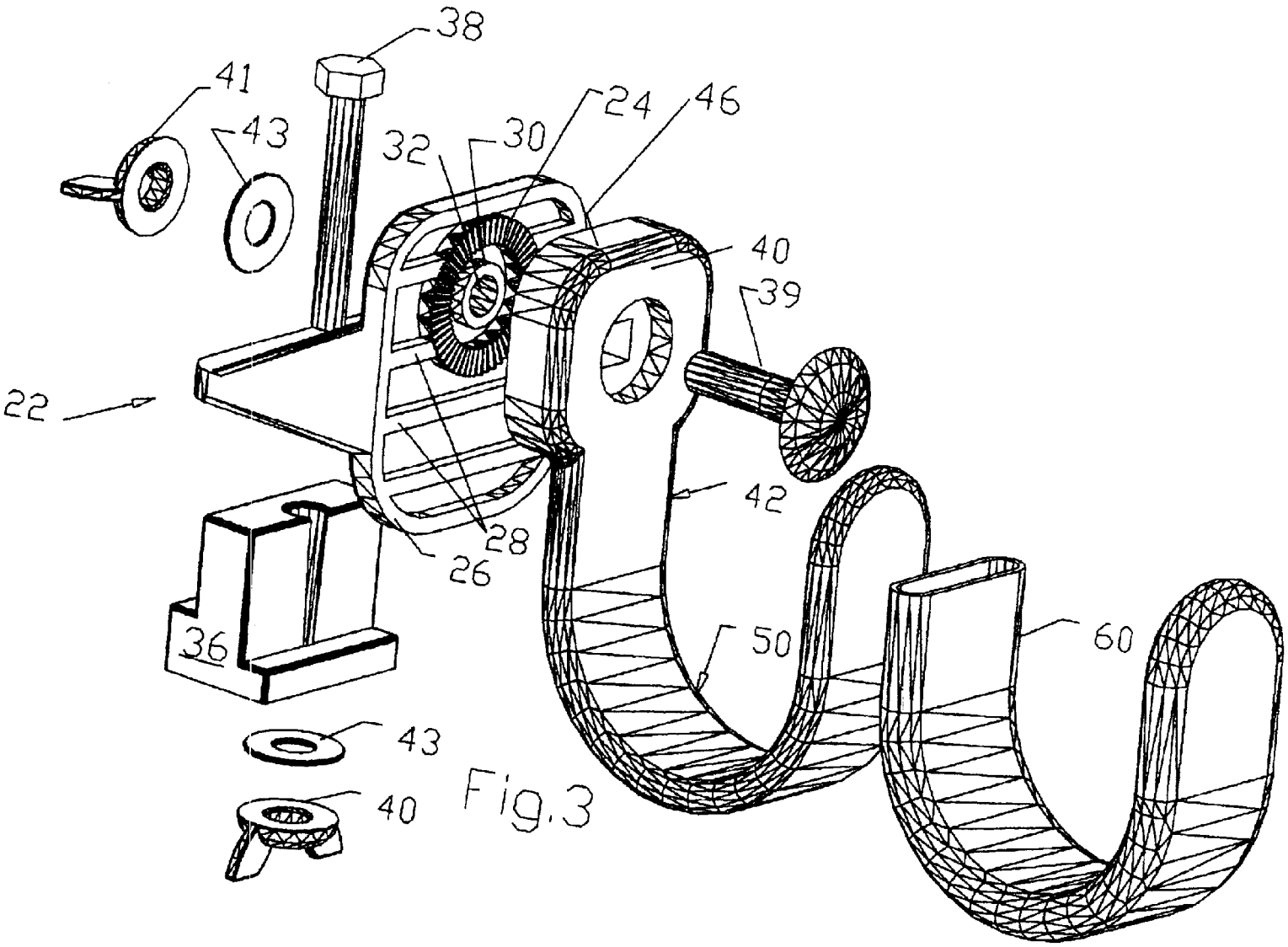
FIG. 3 is an exploded perspective view showing the details of the components in the first embodiment.

A first preferred embodiment of the gun rest of the present invention is shown in FIGS. 1–3 generally at 20. Gun rest 20 comprises a first member or base plate 22 with a first ratchet face 24 on first lateral face 26 (FIG. 3). Gun rest incorporates means 34 to attach it to a frame member 11 of a tree stand (FIG. 1). Means 34, in this embodiment includes T-shaped arm 36 which clamps frame member 11 of tree the stand between laterally extending section 37 of T-shaped arm and flange 25 of first member 22 using bolt 38 and wing nut 40 with washer 43 reducing the risk of undesired loosening and distributes the clamping force of wing nut 40 over a larger surface. The width of the two flanges on the T-shaped arm are different to accommodate varying sizes of frame members 11. Obviously, other clamping means could be used, although this particular means has proven simple and reliable. It is further understood that this clamping means can be used to clamp other items, such as creature comforts, to the frame 11 of the tree stand. Reinforcement ribs 28 provide structural stability while minimizing material usage. The material used to form the first and second members of the gun rest is a high-strength, highly durable plastic. While there are other suitable materials, acrylonitrile-butadiene-styrene (ABS) has proven itself to be suitable for this application. Ratchet face 24 surrounds collar 30 which itself surrounds and defines aperture 32 that receives a second bolt 39.

Second member or gun rest 42 has a second ratchet face (not shown) on first lateral face 46 which mates with first ratchet face 24, the ratchet face surrounding a square opening that engages a neck on the bolt 39 in a conventional manner, to prevent its rotation during securing and removal of wing nut 41. Washer 43 distribute the clamping force applied by wing nut 41 and the head of the bolt 39 over the surface of the mating ratchet faces preventing slippage. The opposing lateral face 48 of second member 42 has a U-shaped support arms 50 extending downwardly and outwardly. Support arm 50 forms a cradle in which a portion of a gun can rest. Support arm 50 is coated with an elastomeric jacket 60 to provide slip resistance. Elastomeric jacket 60 is preferably either a natural or synthetic rubber.

In operation, base plate 22 of gun rest 20 is clamped to frame member 11 of the tree stand by loosening wing nut 40 placing laterally extending section 37 of T-shaped arm 36 on a side of member 11 opposite the side flange 25 occupies and tightening wing nut 40 on bolt 38. Typically, section 37 will engage the bottom surface of member 11 while flange 25 sits on its top surface. Wing nut 41 can be loosened on bolt 39 permitting second member 42 be rotated and adjustably positioned at an optimal position relative to first member 22. When the wing nut 41 is tightened, the two engaged ratchet surfaces will hold the support arm 50 in the desired support position for the gun. It will be understood that two gun rests 20 will be affixed to spaced portions of the member 11 of the tree stand, a first gun rest 20 supporting the stock of the weapon while the other supports the barrel.

Figure 4:
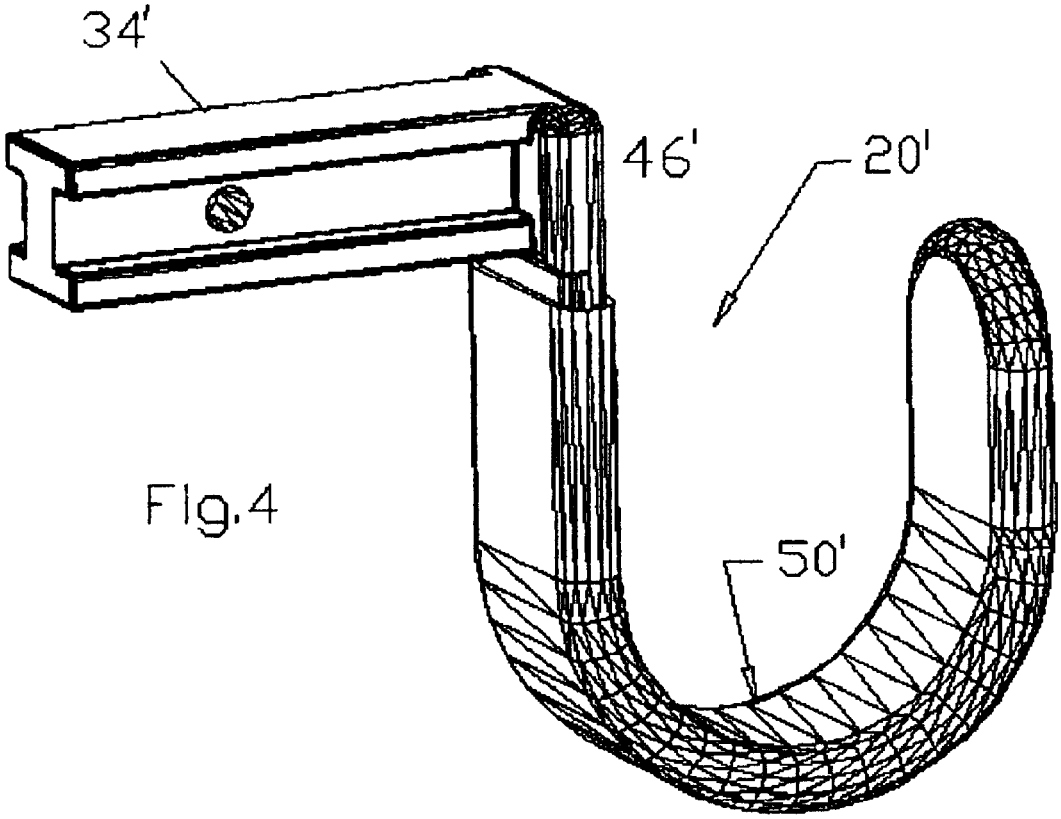
FIG. 4 is a right rear perspective view of a second embodiment of the gun rest of the present invention.

A second embodiment of the gun rest of the present invention is shown in FIG. 4 generally at 20'. In this second embodiment, gun rest 20' comprises the U-shaped support arm 50' with an I-beam shaped dowel 34' made integrally with the rear face 46'. This attachment means, dowel 34', is attached to tree stand frame member 11 by pushing it into the open end thereof, one dowel 34' into each frame member 11. This lower cost version of gun rest 20' lacks the adjustability feature available of the first embodiment, but for some applications, this feature is less important and may be omitted to realize the cost savings.

A number of changes, alternatives and modifications will become apparent after a reading of the foregoing specification. It is intended that all such changes, alternatives and modifications as fall within the scope of the appended claims be considered part of the present invention.

I claim:

1. A gun rest for use with a tree stand comprising a) a first U-shaped member for receiving a first portion of the gun;

b) first attachment means for securing said first U-shaped member to a first frame portion of the tree stand;

c) a second U-shaped member for receiving a second portion of the gun;

d) second attachment means for securing said second U-shaped member to a second frame portion of the tree stand, said second attachment means being separate from said first attachment means;

e) non-slip coating means covering at least portions of each of said first and second U-shaped members;

f) each of said U-shaped members including a first and a second arm and said attachment means for each of said first and second U-shaped members having an integral dowel extending laterally from said first arm of said U-shaped member which is received in an open end of the first and second frame portions of the tree stand;

whereby said first and second U-shaped members engaging first and second portions of the gun, respectively, to maintain the gun in a generally horizontal position to facilitate its being brought to a ready position for firing.

2. The gun rest of claim 1 wherein said integral dowel is I-beam shaped.

3. The gun rest of claim 1 wherein said first and second U-shaped members are comprised of a high strength, high durability plastic.

4. The gun rest of claim 3 wherein said high strength, high durability plastic is ABS.

5. A gun rest for use with a tree stand comprising a) a first U-shaped member for receiving a first portion of the gun;

b) first attachment means for securing said first U-shaped member to a first frame portion of the tree stand;

c) a second U-shaped member for receiving a second portion of the gun;

d) second attachment means for securing said second U-shaped member to a second frame portion of the tree stand, said second attachment means being separate from said first attachment means;

e) non-slip coating means covering at least portions of each of said first and second U-shaped members;

f) a base member attached to each U-shaped member and a T-shaped arm that bolts to each of said base members in an adjustable manner to clamp onto the first and second frame portions, respectively, of the tree stand;

whereby said first and second U-shaped members engaging first and second portions of the gun, respectively, to maintain the gun in a generally horizontal position to facilitate its being brought to a ready position for firing.

6. The gun rest of claim 5 wherein said non-slip coating means comprises rubber.

7. The gun rest of claim 5 wherein said attachment means further comprises a third member with a first ratchet face on a lateral face thereof, said first and second U-shaped members each having complementary ratchet faces on a rear lateral face thereof.

8. The gun rest of claim 7 wherein said attachment means further comprises an T-shaped arm adjustably secured to said third member to clamp a frame portion of the tree stand there between.

9. A gun rest for use with a tree stand comprising a) a first member with a first ratchet face on a first lateral face thereof;

b) attachment means for securing said first member to a portion of the tree stand;

c) a second member with a second ratchet face on a first lateral face thereof, said second ratchet face being engageable with said first ratchet face to adjustably position said second member relative to said first member, said second member having a U-shaped support extending downwardly and outwardly from a second lateral face opposite said first lateral face of said second member;

d) clamping means for securing said second ratchet face in rotationally adjustable contact with said first ratchet face;

e) non-slip coating means covering at least portions of each of said pair of support arms;

whereby two said gun rests are attached to spaced, aligned portions of the tree stand and a gun inserted onto said U-shaped support arms for retention in a desired posture.

10. The gun rest of claim 9 wherein said first and second members are comprised of a high strength, high durability plastic.

11. The gun rest of claim 10 wherein said high strength, high durability plastic is ABS.

12. The gun rest of claim 9 wherein said non-slip coating means comprises rubber.

13. A clamp for use in attaching a first member to a tree stand comprising a) the first member having a first ratchet face on a first lateral face thereof;

b) a second member with a second ratchet face on a first lateral face thereof, said second ratchet face being engageable with the first ratchet face to adjustably position the first member relative to said second member;

c) attachment means for securing said second member to a portion of the tree stand, said attachment means including i) a T-shaped arm, ii) bolt means to secure said T-shaped arm to said second member in an adjustable manner to clamp onto a frame portion of the tree stand;

whereby said bolt means may be loosened to enable the frame portion to be sandwiched between said T-shaped arm and a flange on said second member and tightened to secure the first member in position relative to said frame portion of the tree stand.

14. The clamp of claim 13 wherein said first and second members are comprised of a high durability plastic.

15. The clamp of claim 14 wherein said high strength, high durability plastic is ABS.

* * * * *